US010995521B2

(12) United States Patent
Grimmer et al.

(10) Patent No.: US 10,995,521 B2
(45) Date of Patent: May 4, 2021

(54) LINEAR LOCK

(71) Applicant: STRATTEC SECURITY CORPORATION, Milwaukee, WI (US)

(72) Inventors: Larry R. Grimmer, Sussex, WI (US); Jack Christopher Melkovitz, Wauwatosa, WI (US)

(73) Assignee: STRATTEC SECURITY CORPORATION, Milwaukee, WI (US)

( * ) Notice: Subject to any disclaimer, the term of this patent is extended or adjusted under 35 U.S.C. 154(b) by 206 days.

(21) Appl. No.: 16/019,661

(22) Filed: Jun. 27, 2018

(65) Prior Publication Data

US 2020/0002976 A1 Jan. 2, 2020

(51) Int. Cl.

| | |
|---|---|
| ***E05B 29/00*** | (2006.01) |
| ***E05B 67/24*** | (2006.01) |
| ***E05B 19/00*** | (2006.01) |
| *E05B 17/14* | (2006.01) |

(52) U.S. Cl.

CPC ..... *E05B 29/0046* (2013.01); *E05B 19/0064* (2013.01); *E05B 29/0053* (2013.01); *E05B 29/0066* (2013.01); *E05B 67/24* (2013.01); *E05B 17/142* (2013.01)

(58) Field of Classification Search

CPC ..... E05B 29/0046; E05B 29/0053; E05B 29/0066; E05B 19/0064; E05B 17/142; E05B 29/00; E05B 27/086

USPC ..... 70/38 A, 493, 387, 495, 496

See application file for complete search history.

(56) References Cited

U.S. PATENT DOCUMENTS

| | | | | |
|---|---|---|---|---|
| 285,207 | A * | 9/1883 | Barnes | E05B 27/086 70/496 |
| 419,091 | A * | 7/1890 | Williams | E05B 27/086 70/496 |
| 556,309 | A | 3/1896 | Deibert | |
| 565,622 | A | 8/1896 | Kennedy et al. | |
| 919,259 | A | 4/1909 | Simpson | |
| 1,295,351 | A | 2/1919 | Morgan | |

(Continued)

FOREIGN PATENT DOCUMENTS

| | | |
|---|---|---|
| CN | 106808999 A1 | 6/2017 |
| EP | 0 556 505 B1 | 8/1993 |

(Continued)

*Primary Examiner* — Suzanne L Barrett

(74) *Attorney, Agent, or Firm* — Michael Best & Friedrich LLP

(57) ABSTRACT

A linearly-actuated lock including a housing, a lock case received within the housing along an axis, and a lock barrel rotatable relative to the lock case between a locked state and an unlocked state. The lock barrel includes tumblers and tumbler springs. The lock further includes a key insertable into the lock barrel to displace the tumblers relative to the lock barrel in a direction parallel to the axis and a sidebar extending through apertures of the lock barrel. The sidebar is engageable with a notch of the tumblers when the sidebar moves radially inward relative to the axis. The sidebar includes a cam surface slidable against at least one of the housing and the lock case when the lock barrel rotates. The sidebar also includes a projection having a single-ramped surface received within the notch of each tumbler when the lock barrel is in the unlocked state.

20 Claims, 7 Drawing Sheets

(56) References Cited

U.S. PATENT DOCUMENTS 1,899,739 A 2/1933 Von Mehren
2,036,738 A 4/1936 Zygmunt
2,036,747 A * 4/1936 Fitz Gerald ..... E05B 19/00 70/496
2,391,834 A * 12/1945 Johnstone ..... E05B 27/086 70/491
2,525,344 A 6/1947 Garniss
2,431,894 A 12/1947 Spain
2,687,638 A 8/1954 Abernathy
2,772,557 A 12/1956 Audicio
2,982,121 A 5/1961 George
3,541,818 A 11/1970 Dana
3,599,455 A * 8/1971 Pilvet ..... E05B 27/086 70/123
3,604,231 A 9/1971 Buschi
3,733,863 A 5/1973 Toepfer
3,868,838 A 3/1975 Zimmerman et al.
3,903,720 A 9/1975 Scherbing
3,945,229 A 3/1976 Frank
4,012,931 A * 3/1977 Harunari ..... E05B 27/086 70/496
4,069,695 A 1/1978 Frank
4,138,868 A 2/1979 Richards, Sr.
4,341,102 A 7/1982 Ku et al.
4,446,709 A 5/1984 Steinbach
4,556,872 A 12/1985 Masoncup et al.
4,660,395 A 4/1987 Huang et al.
4,671,711 A 6/1987 Steinbach et al.
4,677,835 A 7/1987 Almblad
4,735,069 A 4/1988 Steinbach
4,811,578 A * 3/1989 Masoncup ..... E05B 45/005 340/542
4,831,852 A 5/1989 Hughes
4,838,060 A 6/1989 Hutzenlaub
4,858,455 A 8/1989 Kuo
4,934,164 A 6/1990 Shew
4,941,335 A 7/1990 Allen
4,977,768 A 12/1990 Embry
5,133,203 A 7/1992 Huang
5,195,340 A 3/1993 Huang
5,201,203 A 4/1993 Almblad
5,233,851 A 8/1993 Florian
5,587,702 A 12/1996 Chadfield
5,638,713 A 6/1997 Roth et al.
5,687,594 A 11/1997 Wang
5,727,405 A 3/1998 Cromwell
5,819,569 A 10/1998 Herdman
5,964,108 A 10/1999 McBride
6,038,898 A 3/2000 Cliff
6,584,819 B1 7/2003 Hung
6,634,197 B2 * 10/2003 Widen ..... E05B 9/086 70/337
6,644,078 B1 11/2003 Hung
6,708,533 B2 3/2004 Lavikainen et al.
6,718,808 B2 4/2004 Yu
7,150,168 B1 12/2006 Kuo
7,171,833 B1 2/2007 Wu
7,234,330 B2 6/2007 Tseng
7,278,283 B2 * 10/2007 Meckbach ..... E05B 15/16 292/DIG. 38
7,448,239 B1 * 11/2008 Huang ..... E05B 27/005 70/340
7,454,934 B2 11/2008 Lin
7,475,579 B2 1/2009 Miao
7,484,392 B2 2/2009 Katagiri
7,716,960 B2 * 5/2010 Tamezane ..... E05B 29/0006 70/361
7,958,760 B2 6/2011 Widen
8,186,194 B2 * 5/2012 Field ..... E05B 27/0078 70/491
8,336,346 B2 * 12/2012 Mah ..... E05B 67/22 70/352
8,336,348 B2 12/2012 Dalton, Jr. et al.
9,157,256 B2 * 10/2015 Hiscocks ..... E05B 27/0003
9,322,196 B2 * 4/2016 Garthe ..... E05B 67/24
9,416,561 B2 * 8/2016 Field ..... E05B 19/0064
9,464,462 B1 10/2016 Liu
10,024,079 B2 7/2018 Walls et al.
2004/0231379 A1 11/2004 Yu
2005/0081584 A1 4/2005 Nugent
2006/0096344 A1 * 5/2006 Lee ..... E05B 27/0032 70/491
2007/0033975 A1 2/2007 Liu
2007/0131008 A1 6/2007 Brunke et al.
2007/0186601 A1 8/2007 Lin
2012/0186308 A1 * 7/2012 Garthe ..... E05B 39/04 70/35
2015/0184423 A1 * 7/2015 Chen ..... E05B 47/0611 70/344
2019/0323268 A1 * 10/2019 Fan ..... E05B 67/02

FOREIGN PATENT DOCUMENTS

EP 1 264 059 B1 12/2002
EP 1 808 560 B1 7/2007
WO 2010/102326 A1 9/2010

* cited by examiner

LINEAR LOCK

BACKGROUND

The present invention relates to keyed locks for providing secured access to doors such as building or vehicle doors, ignition switches for vehicles, or start-up switches for other powered machines, and other devices. The present invention also relates to keyed locks, e.g., padlocks, that may be used as a safety lock or tag-out lock in applications where safety is a primary concern over security.

SUMMARY

In one aspect, the invention provides a linearly-actuated lock including a housing, a lock case received within the housing along an insertion axis, and a lock barrel rotatable relative to the lock case between a locked state and an unlocked state. The lock barrel defines tumbler passageways which enclose corresponding tumblers and tumbler springs. The linearly-actuated lock further includes a key insertable into the lock barrel to displace the tumblers relative to the lock barrel in a direction parallel to the insertion axis and a sidebar extending through apertures of the lock barrel. The sidebar is engageable with a notch of the tumblers when the sidebar moves radially inward relative to the insertion axis. The sidebar includes a cam surface slidable against at least one of the housing and the lock case when the lock barrel rotates between the locked state and the unlocked state. The sidebar also includes a projection having a single-ramped surface that is received within the notch of each tumbler when the lock barrel is in the unlocked state.

In another aspect, the invention provides a lock including a housing and a lock barrel having a first end configured to receive a key along an insertion axis and a second end, opposite the first end. The lock barrel includes a plurality of tumbler passageways open to the second end. Each of the plurality of tumbler passageways extends substantially parallel with the insertion axis. The lock further includes a plurality of tumblers and corresponding tumbler springs received in the plurality of tumbler passageways, and a sidebar extending through an aperture of the lock barrel. The sidebar is engageable with a notch of the tumblers when the sidebar moves radially inward relative to the insertion axis. The sidebar includes a cam surface slidable against the housing when the lock barrel rotates about the insertion axis and a projection having single-ramped surface that is received within the notch of each tumbler when the lock barrel is in the unlocked state.

In yet another aspect, the invention provides a linearly-actuated lock including a lock cylinder defining an insertion axis, a plurality of tumblers and corresponding tumbler springs are received in passageways in the lock cylinder, a sidebar movable radially inward relative to the insertion axis in response to movement of the plurality of tumblers in a direction parallel to the insertion axis, and a lock driver is removably coupled to the lock cylinder. The lock driver does not enclose the tumblers, the tumbler springs, or the sidebar. The sidebar includes a cam surface and a projection having a single-ramped surface that is capable of being received within the notch of each tumbler.

Other aspects of the invention will become apparent by consideration of the detailed description and accompanying drawings.

DETAILED DESCRIPTION

Figure 1:
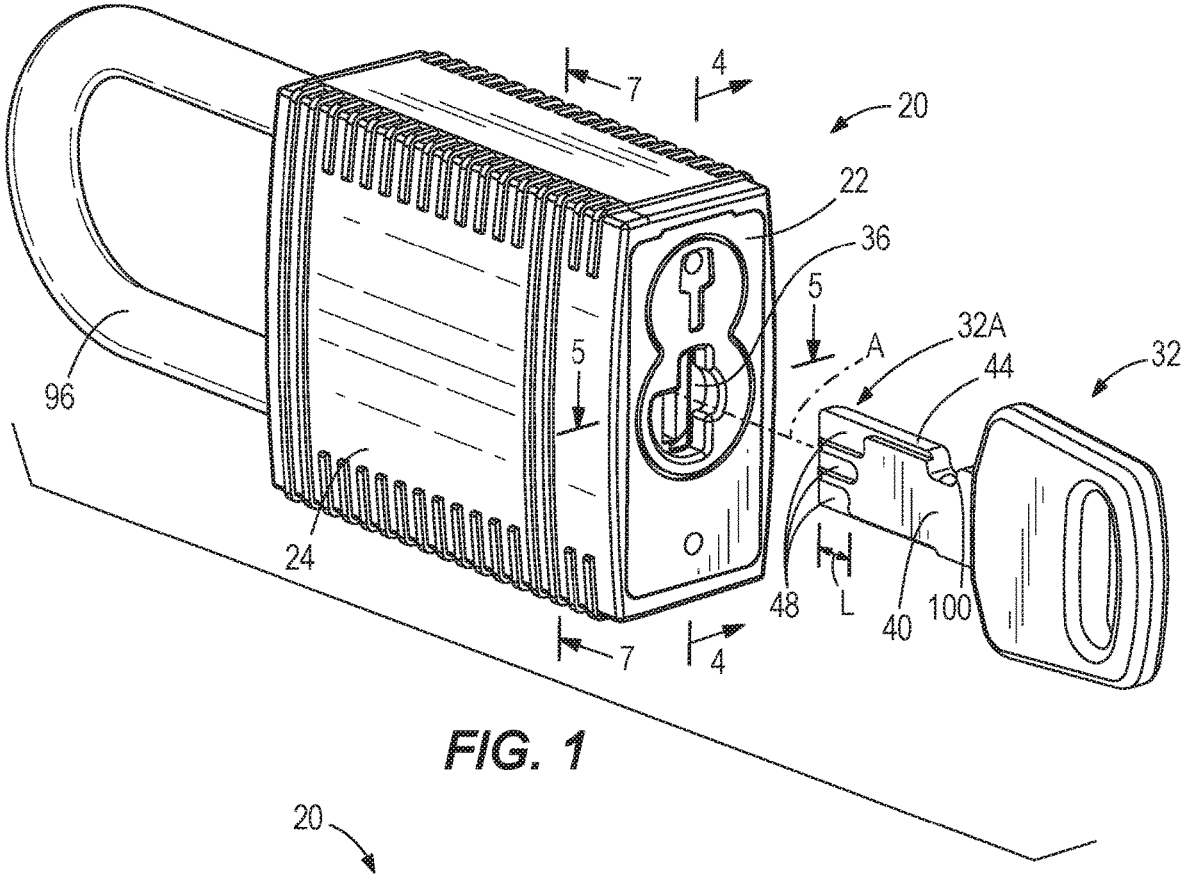
FIG. 1 is a perspective view of a lock and a key.
Figure 2:
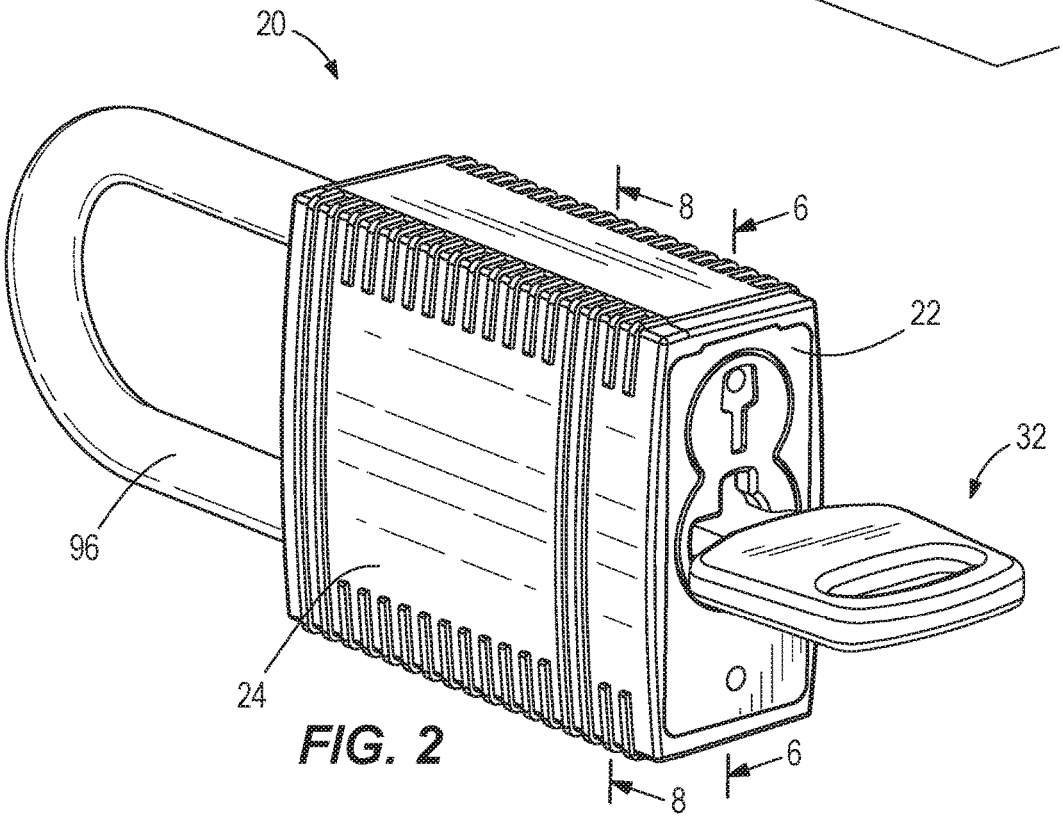
FIG. 2 is a perspective view of the lock of FIG. 1 with the key fully inserted and rotated toward an unlocked state.
Figure 3:
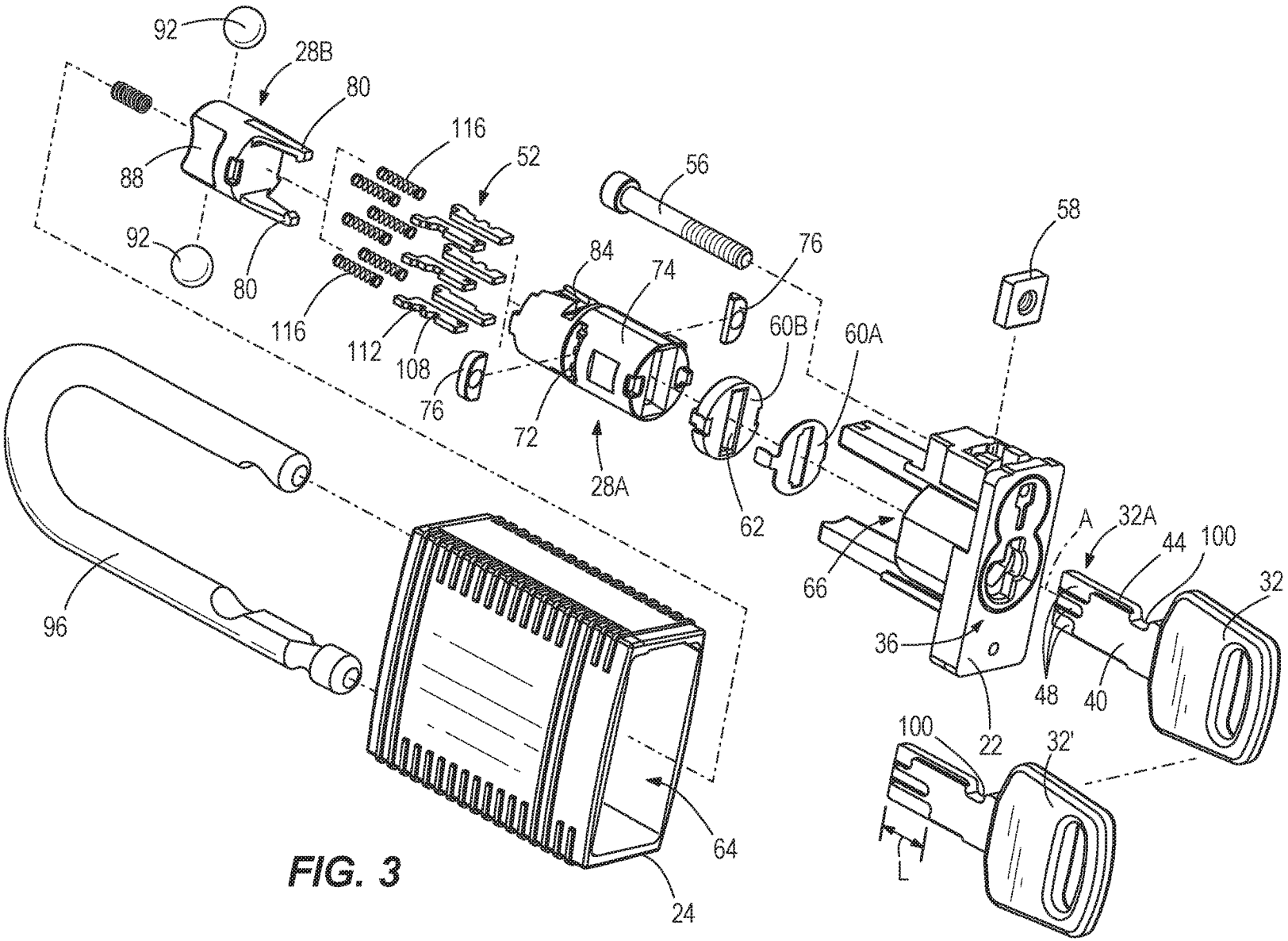
FIG. 3 is an exploded assembly view of the lock and key of FIG. 1.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

FIGS. 1-8 illustrate a key-operated lock 20, such as a padlock. The lock 20 includes a lock case 22 and a housing 24 that shrouds a lock barrel 28A, 28B. A key 32 is insertable into the lock 20 along a key insertion axis A. Specifically, the key 32 is insertable through a key slot 36 defined through the lock case 22. The key 32 includes two opposed flat sides 40 and two edges 44. The flat sides 40 are significantly wider than the edges 44 in the illustrated construction. A plurality of grooves 48 are formed adjacent a first end 32A of the key 32. In the illustrated construction, three grooves 48 are formed in each of the flat sides 40 of the key 32, although alternate configurations could be used. Each of the grooves 48 has a defined axial length L measured from the first end 32A of the key 32 (one such length L is labeled in FIG. 1 for exemplary purposes). Although the illustrated embodiment shows that each of the grooves 48 on one side 40 of the key 32 has a different length than the remaining grooves 48, in other embodiments, some or all of the grooves 48 of the key 32 may be the same length as this corresponds to one of many key code combinations. As described in further detail below, each of the grooves 48 engages and actuates a corresponding tumbler 52 in a linear manner (parallel with the key insertion axis A).

In the illustrated construction, the lock case 22 is received within and coupleable to the housing 24. Specifically, a threaded fastener 56 is insertable through the housing 24 to threadably engage a nut 58 of the lock case 22, thereby coupling the housing 24 and the case 22 together. The lock case 22 is received within a cavity 64 of the housing 24. A two-piece cap 60A, 60B is coupled to the lock barrel 28A, 28B adjacent the key slot 36. The cap 60B includes a deformable shutter 62 to selectively block entry of the key 32 into the lock 20 and inhibit dirt and other debris from entering the lock barrel 28A, 28B. A cavity 66 receives the lock barrel 28A, 28B as well as other components operatively coupled to or received within the lock barrel 28A, 28B. A pair of lobed recessed grooves or channels 68 are formed in the housing 24. The two recessed channels 68 are disposed 180 degrees apart from each other about the axis A. A first one of the two barrel portions, the lock cylinder 28A, includes two apertures 72 extending through a side wall 74 thereof. The apertures 72 are in register with the two recessed channels 68 of the housing 24.

With reference to FIGS. 3-8, a pair of sidebars 76 are received in the respective apertures 72. Each sidebar 76 includes a cam body defining a cam surface 78 that is engageable with the corresponding recessed channel 68 in the housing 24 and a projection defining a single-ramped surface 79. As described in further detail below, the sidebars 76 are selectively radially retracted from the recessed channels 68 to allow rotation of the lock cylinder 28A relative to the housing 24 toward an unlocked state. The projection of the sidebar 76 is shaped similar to a right-trapezoid such that it includes the single-ramped surface 79 leading to a plateau region. Conventionally, sidebars have a single peak formed due to two ramped surfaces merging at a point. Stated another way, the projection is asymmetric such that one side of the projection has the ramped surface 79 while the other opposite side is not ramped. Also, the ramped surface 79 extends in a direction skewed with respect to the axis A. The single-ramped surface 79 reduces dimensional tolerance stacks, and thereby inhibits inadvertent use of "cousin" keys. As understood by one of ordinary skill in the art, cousin keys include a key code combination (e.g., grooves) that is similar to the key code combination (e.g., length L of the grooves 48) of the key 32, such that the cousin key is capable of accidently unlocking the lock 20.

A second one of the two barrel portions, the lock driver 28B, is engaged with an end (e.g., "rear" end) of the lock cylinder 28A that is opposite the key insertion end (e.g., "front" end). The lock driver 28B is configured to be rotated with the lock cylinder 28A when the proper key 32 is inserted and twisted or rotated in the lock 20. In the illustrated construction, the lock driver 28B includes two arms 80 that engages corresponding recesses 84 in the rear end of the lock cylinder 28A. The lock driver 28B may act on a latch (not shown) or any other member which is configured to be locked and unlocked by the lock 20. It should be appreciated that the lock 20 may be used in many different applications including, but not limited to, padlocks, safety lockouts, safety tag-outs, doors on buildings and vehicles, and keyed ignition or start-up switches for vehicles and other machinery. In this particular embodiment, the lock driver 28B includes two recessed channels 88 that are disposed 180 degrees apart from each other about the axis A. The two recessed channels 88 are capable of selectively receiving corresponding locking balls 92. The recessed channels 88 align with the locking balls 92 when the lock driver 28B co-rotates with the lock cylinder 28A toward the unlocked state, thereby permitting the locking balls 92 to retract radially inward and avoid interference with a locking latch 96, e.g., shackle of padlock.

Figure 5:
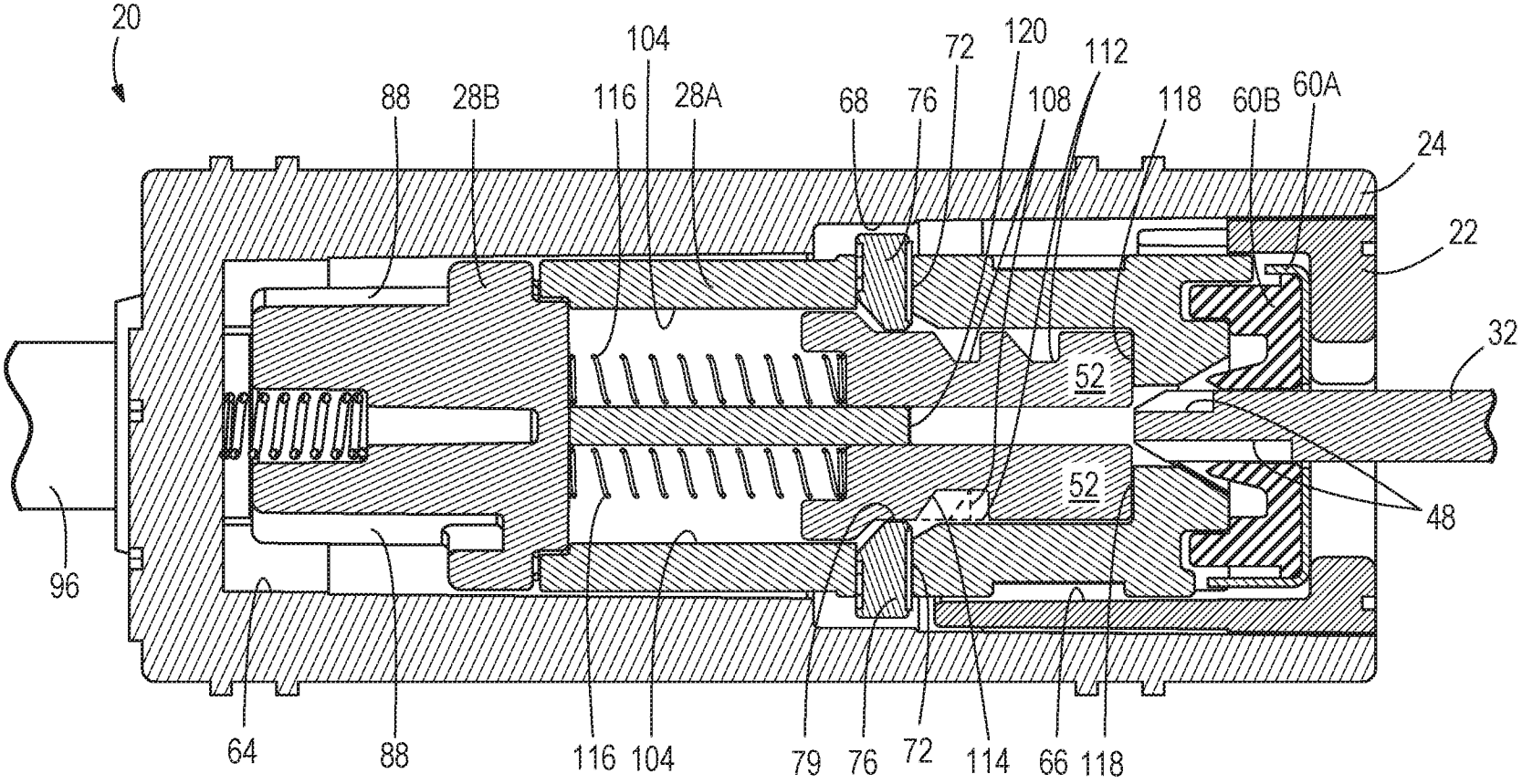
FIG. 5 is a cross-sectional view of the lock, taken along line 5-5 of FIG. 1 with the key partially inserted.

A plurality of passageways 104 corresponding to the plurality of tumblers 52 are formed in the interior of the lock cylinder 28A. Each passageway 104 is elongated in a direction parallel to the axis A and is configured to slidably receive one of the tumblers 52 therein. The tumblers 52 are insertable into the passageways 104 from the rear of the lock cylinder 28A, opposite the key-receiving front end. In the illustrated construction, both the passageways 104 and the tumblers 52 have substantially rectangular cross-sections. As shown in the figures, the tumblers 52 are arranged in two groups of three to correspond to the two sets of grooves 48 in the key 32. However, smaller groups of tumblers 52 could be provided to reduce the overall size of the lock 20 (and the required key width) at the expense of unique key-coding possibilities. As described further below, the groups of tumblers 52 may be even larger than three in some constructions to provide greater key-coding possibilities. Returning to the illustrated construction, one group of three tumblers 52 is configured to interact with a first one of the sidebars 76, and the other group of three tumblers 52 is configured to interact with a second one of the sidebars 76. Each respective sidebar 76 extends transversely across the set of three tumblers 52. Each one of the tumblers 52 is formed with a primary notch 108 and a secondary notch 112 disposed on an outward-facing side thereof (to face the corresponding sidebar 76), both of which are capable of selectively receiving sidebars 76. Each notch 108, 112 is shaped to be a complimentary cutout of the projection (with single-ramped surface 79) of the sidebars 76, such that the each notch 108, 112 includes a single ramped surface 114. In other embodiments, the axial positioning of each notch 108, 112 along the tumbler 52 may overlap and merge to form one double-length notch rather than two separate notches 108, 112. Each tumbler 52 is biased toward the front end of the lock cylinder 28A by a corresponding spring 116 (FIG. 5). Like the tumblers 52, the springs 116 are insertable into the passageways 104 from the rear end of the lock cylinder 28A. Coupling the lock driver 28B to the cylinder 28A closes the passageways 104 and retains the tumblers 52 and the springs 116 in the passageways. The single ramped surface 114 of each notch 108, 112 is on the side facing the tumbler springs 116. The single ramped surface 114 of each notch 108, 112 extends in a direction skewed with respect to the axis A.

The springs 116 bias the tumblers 52 toward the front end of the lock cylinder 28A. As shown in FIG. 5, the springs 116 bias each group of tumblers 52 into contact with an abutment surface 118 to define an at-rest position of the tumblers 52. Unless all the tumblers 52 are moved from the at-rest position to align the primary notches 108 or the secondary notches 112 with the sidebars 76 (FIG. 6), the tumblers 52 block radially inward movement of the sidebars 76 (FIGS. 5 and 7), keeping the sidebars 76 trapped within the recessed channels 68 and preventing rotation of the lock barrel 28A, 28B with respect to the housing 24 toward the unlocked state.

Figure 4:
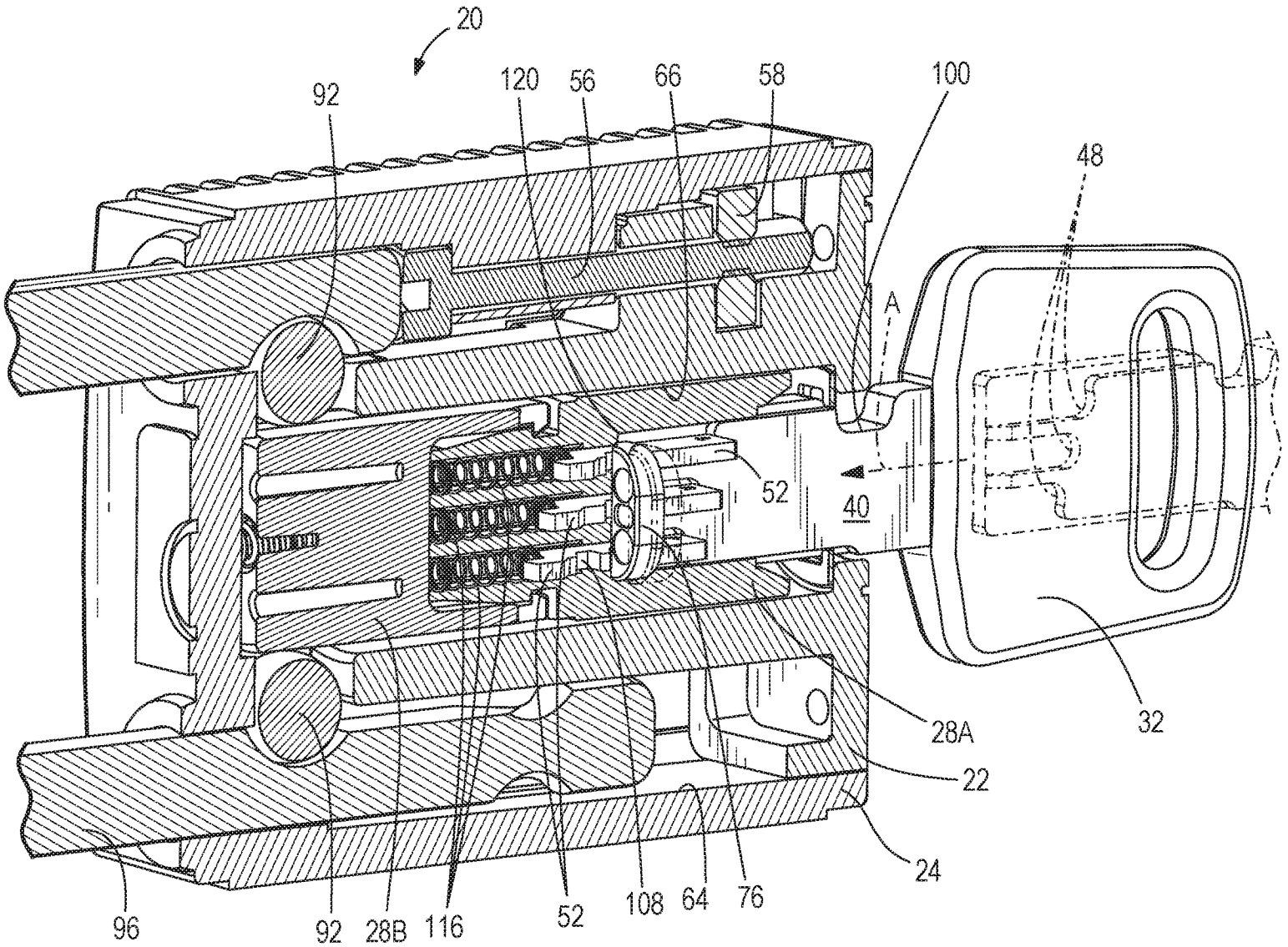
FIG. 4 is a cross-sectional view of the lock, taken along line 4-4 of FIG. 1 with the key fully inserted.
Figure 6:
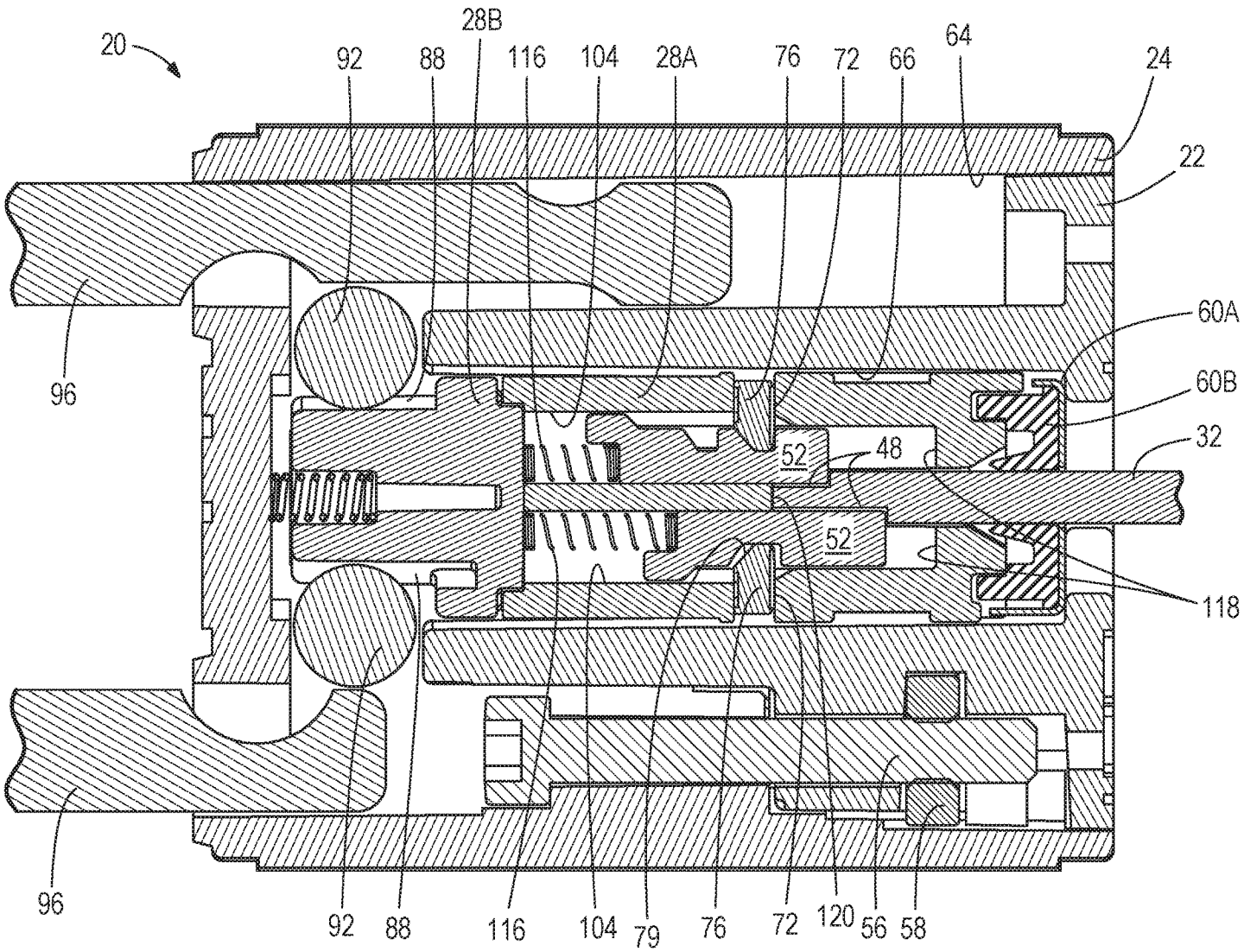
FIG. 6 is a cross-sectional view of the lock, taken along line 6-6 of FIG. 2 with the key fully inserted and rotated toward the unlocked state.
Figure 7:
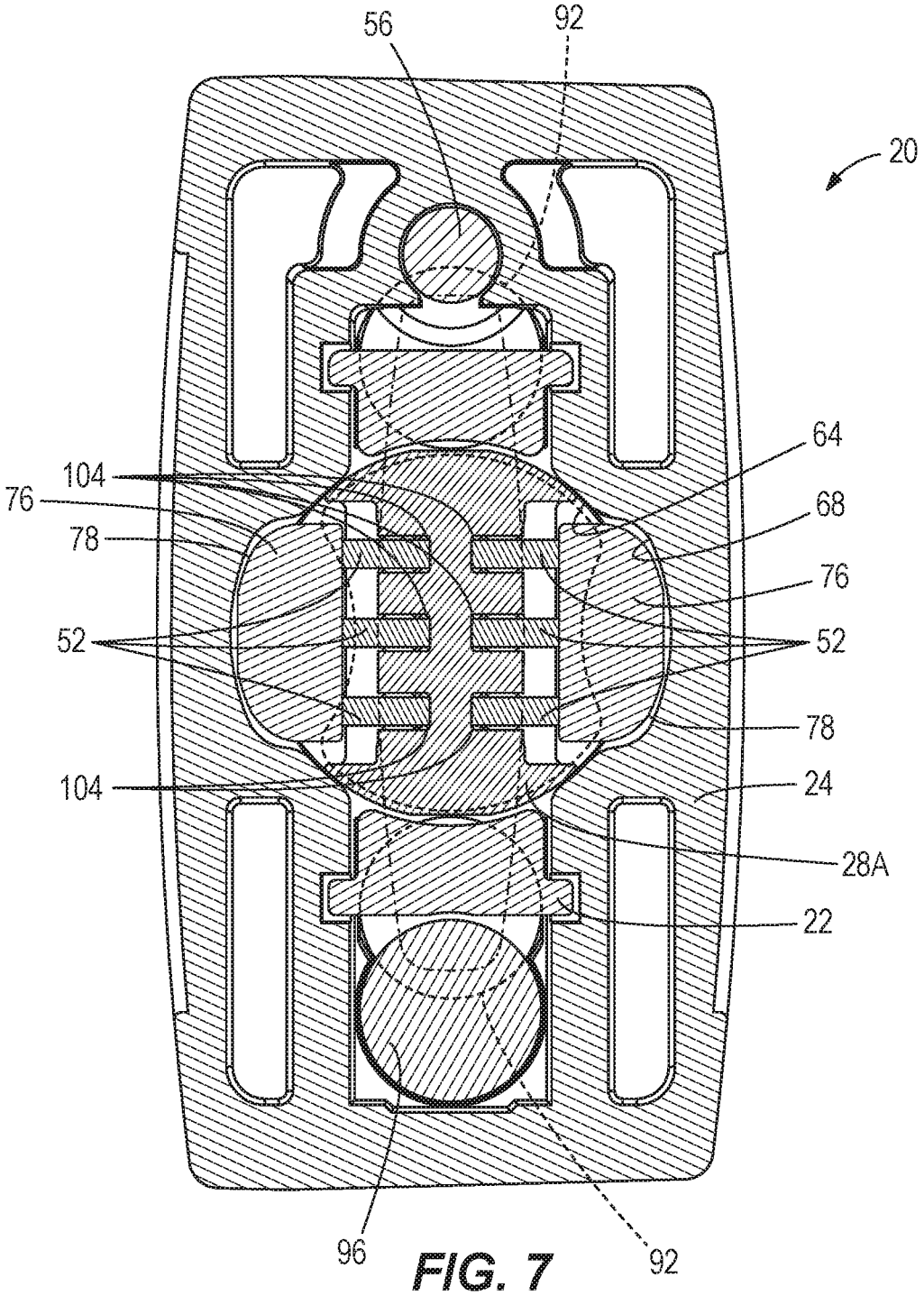
FIG. 7 is a cross-sectional view of the lock, taken along line 7-7 of FIG. 1.
Figure 8:
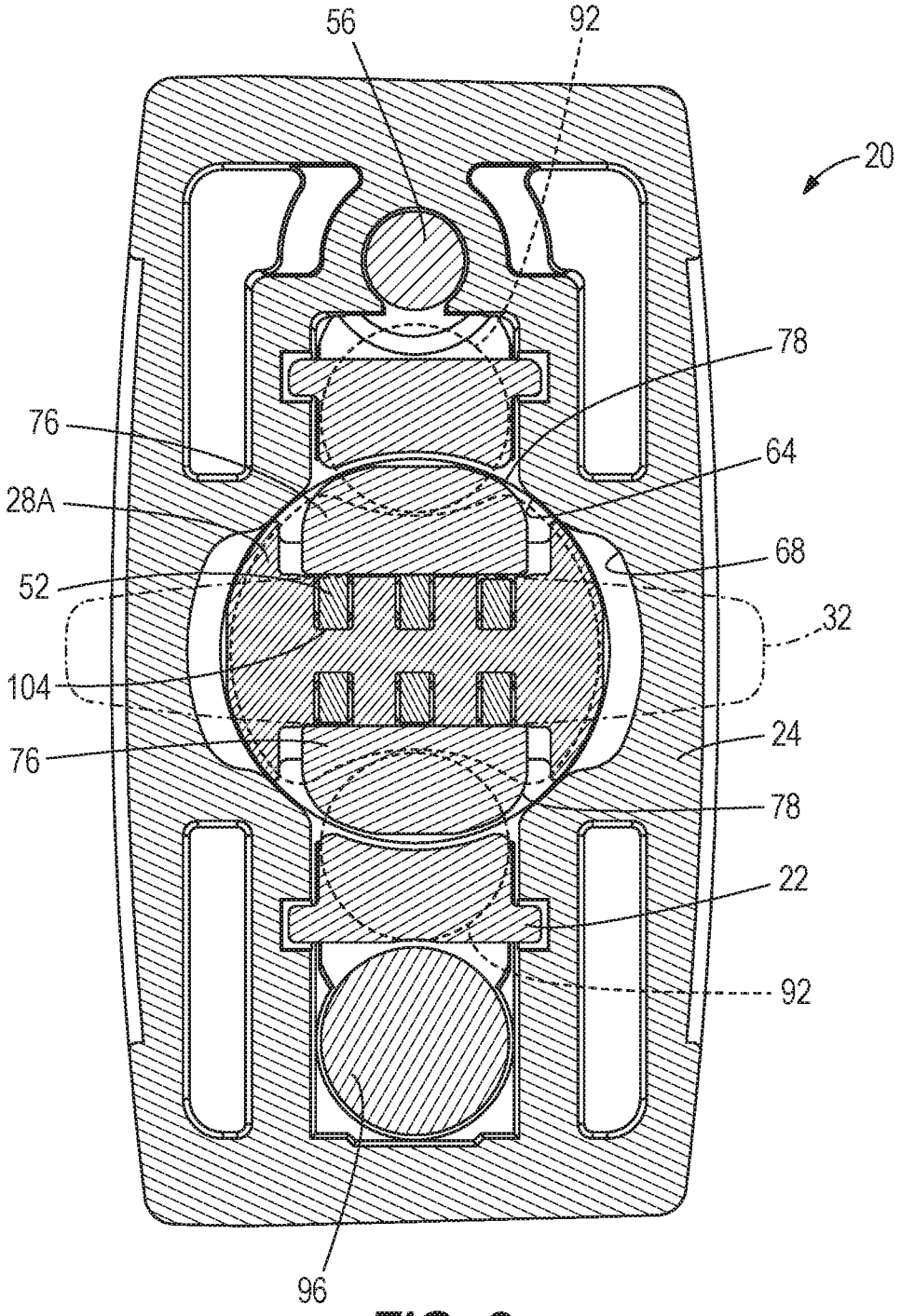
FIG. 8 is a cross-sectional view of the lock, taken along line 8-8 of FIG. 2.

The primary notches 108 and the secondary notches 112 are located at various axial positions on the tumblers 52. The positions of the primary notches 108 correspond to the lengths L of the corresponding key grooves 48 of the key 32 (e.g., a change key) that actuate the respective tumblers 52, whereas the positions of the secondary notches 112 correspond to the lengths L of the corresponding key grooves 48 of a key 32' (e.g., a master key) that actuate the respective tumblers 52. Thus, as described further below, insertion of the change key 32 to a predetermined depth into the lock cylinder 28A moves all of the primary notches 108 of all of the tumblers 52 into alignment with the sidebars 76 (FIGS. 4 and 6). Similarly, insertion of the master key 32' to a predetermined depth into the lock cylinder 28A moves all of the secondary notches 112 of all of the tumblers 52 into alignment with the sidebars 76. In cases where the primary notch 108 and the secondary notch 112 create the double-length notch (as described above), insertion of either key 32, 32' to a predetermined depth into the lock cylinder 28A moves the double-length notch of the tumblers 52 into alignment with the sidebars 76. The predetermined key insertion depth may be a full insertion depth, whereby the first end 32A of the key 32 contacts an abutment surface 120 on the interior of the lock cylinder 28A adjacent the tumbler passageways 104.

In order to operate the lock 20 (i.e., to rotate the lock driver 28B relative to the housing 24 to lock or unlock a component coupled thereto), the grooves 48 provided in the key 32 must have lengths L particularly matched with the axial positioning of the primary notches 108 in each of the tumblers 52 inside the lock cylinder 28A. In the illustrated embodiment, a combination of six matching grooves 48 and tumblers 52 is required. As shown, the key 32 has a first set of grooves 48, with a unique combination of lengths L, on one side of the key 32. A second set of grooves 48 with lengths L that match those of the first set are provided on the opposite side of the key 32. By providing two matching sets of grooves 48, the key 32 is reversible (i.e., can be inserted in either orientation to operate the lock 20).

Individual locks 20 may be "coded" or uniquely-keyed by grouping and ordering the three tumblers 52 of each group from a large collection of available tumblers 52, each having a different axial placement of the primary notch 108. The number of available tumblers 52 corresponds to the number of different lengths L possible for the key grooves 48. In the illustrated construction, the three tumblers 52 in a group may be selected from a collection of seven available tumblers 52. Thus, for a given lock 20, 343 ($7^3$) unique key-coding combinations are possible. Increasing the number of tumblers 52 in the collection, each having a unique primary notch 108 placement, increases the amount of key-coding combinations. With a conventional lock, the recesses in the key for receiving the tumbler pins have a total number of distinguishable depths that is ultimately limited by the key width (e.g., all depths less than half of a key width that is less than 1 cm). On the other hand, the number of distinguishable tumblers 52 and corresponding grooves 48 in the key 32 is only limited by the axial length of the lock 20 and the key 32. By removing the dependency on key width for coding, the lock 20 is able to achieve superior key-coding possibilities without providing an oversized key. The ability to axially elongate the lock 20 and the key 32 makes for virtually unlimited key-coding possibilities.

Although the key-coding advantages of the illustrated lock 20 are described above, the lock 20 may be modified from the illustrated construction to provide even greater key-coding possibilities. For example, the tumblers 52 can be provided in larger groups (e.g., 4 or more). This may be accomplished by at least one of: reducing the space between adjacent pairs of tumblers 52 (and adjacent pairs of grooves 48), making the tumblers 52 and grooves 48 narrower within a given key width, and enlarging the lock cylinder 28A and the key width to provide room for additional tumblers 52 and grooves 48, respectively. Alternately, greater key-coding possibilities can be enabled by providing the tumblers 52 (and the key grooves 48) in non-matched groups or sets. However, this would require the key 32 to be inserted in a single, predetermined orientation since the grooves 48 on each side of the key 32 would be specifically matched to the tumblers 52 on one side of the lock 20.

When a user with the matching key 32 inserts the key 32 into the lock 20, the shutter 62 (being made of a flexible material) deforms to allow passage of the key 32. In FIG. 5, the key 32 has just begun to engage the tumblers 52. However, the tumblers 52 are not driven to move from their at-rest positions until engaged by the back end of the corresponding grooves 48 in the key 32. As shown in FIGS. 4 and 6, the tumblers 52 have slid fully into the grooves 48, and further inward movement of the key 32 has caused the tumblers 52 to move off of the abutment surfaces 118 against the bias of the springs 116 until the first end 32A of the key 32 contacts the abutment surface 120. With the key 32 in this fully-inserted position, all of the tumblers 52 are positioned such that their primary notches 108 are aligned with the sidebars 76.

Once the key 32 is fully inserted, the key 32 can be used to rotate the lock barrel 28A, 28B within the housing 24 to the unlocked state. With the key 32 fully inserted, the sidebars 76 may or may not immediately drop into the notches 108 in the corresponding group of tumblers 52 because the sidebars 76 are not spring-biased. However, torque applied to the key 32 will cause the cam surface 78 of the sidebars 76 to cam against the recessed channels 68 of the housing 24 so that they are driven radially inward and become substantially fully seated within the primary notches 108. Once the lock barrel 28A, 28B is rotated from the position of FIG. 7 to the position of FIG. 8, a notch 100 in the key 32 interferes with a portion of the lock case 22, thereby keeping the key 32 from being pulled out of the lock 20. The key 32 can only be pulled out of the lock 20 in the same orientation as inserted.

As mentioned above, the lock driver 28B selectively engages, disengages, or moves another component (not shown) upon a predetermined angle of rotation about the axis A. The predetermined angle may be about 90, 180 or 360 degrees, for example. Once the desired rotation of the lock driver 28B has been completed to perform the desired operation (e.g., locking or unlocking the component), the lock barrel 28A, 28B is rotated by action of the key 32 back to the original orientation in which the key 32 was inserted (FIG. 1). With the sidebars 76 re-aligned with the recessed channels 68, the key 32 can be removed along the axis A. With the key 32 removed, the springs 116 urge the tumblers 52 into re-engagement with the abutment surface 118. By doing so, the ramped surface 114 of the notches 108, 112 and the single-ramped surface 79 of the sidebars 76 slide against one another to urge the sidebars 76 radially outward relative to the insertion axis A into re-engagement with the recessed channels 68.

The security provided by the lock 20 is superior to conventional locks in several respects. First, as described above, many unique combinations are possible with the tumblers 52 and the grooves 48, and the number of tumblers 52 or combinations is not necessarily limited by a predetermined key length, since the axial length of the key 32 for the lock 20 does not necessarily correspond to the number of possible combinations. Furthermore, key replication is more difficult since conventional key cutting tools found at hardware stores, car dealerships, etc. are not configured to cut keys with grooves extending longitudinally from the tip of the key, such as the grooves 48 on the illustrated key 32. The lock 20 is also highly pick-resistant and bump-resistant. The notch 100 in the key 32 acts as a rotation-locking feature (in addition to the sidebars 76). Furthermore, providing multiple sidebars 76 allows the lock cylinder 28A to withstand greater torque values without rotating relative to the housing 24.

The lock 20 also may be able to have a smaller outside diameter than locks with conventional radial tumbler pins since the tumblers 52 of the lock 20 are acted on by the end 32A of the key 32. A smaller key notch active area also means that less room is needed on a key fob. The key 32 will experience less wear than conventional keys since its grooves 48 are not subjected to frequent sliding contact against the internals of the lock 20. Likewise, the tumblers 52 also experience reduced wear. The lack of sliding contact of the lock internals against the key 32 also provides a smooth insertion and extraction feel. In some constructions, the key 32 may be made out of plastic. Overall, the lock 20 comprises fewer parts than conventional locks. It should be noted that the sidebars 76 are not spring-biased, and neither retainers nor staking are required.

The lock driver 28B may be easily interchangeable for use with various tail/lever geometries for different useful applications without substantial change to the remainder of the lock 20. The lock 20 is also capable of being master-keyed. Overall, the lock 20 offers many advantages, some of which are discussed herein, without a substantial increase in cost compared to conventional locks.

Various features of the invention are set forth in the following claims.

What is claimed is:

1. A linearly-actuated lock comprising:

a housing;

a lock case received within the housing along an insertion axis;

a lock barrel rotatable relative to the lock case between a locked state and an unlocked state, wherein the lock barrel defines tumbler passageways which enclose corresponding tumblers and tumbler springs;

a key insertable into the lock barrel to displace the tumblers relative to the lock barrel in a direction parallel to the insertion axis against a bias from the tumbler springs;

a sidebar extending through apertures of the lock barrel, the sidebar is engageable with a notch of the tumblers when the sidebar moves radially inward relative to the insertion axis, wherein the sidebar includes a cam surface slidable against at least one of the housing and the lock case when the lock barrel rotates between the locked state and the unlocked state, and a projection having a single-ramped surface that is received within the notch of each tumbler when the lock barrel is in the unlocked state, and wherein the sidebar is not spring-biased.

2. The lock of claim 1, further comprising a fastener extending through the housing and threadably coupled to a nut of the lock case, thereby removably coupling the housing to the lock case.

3. The lock of claim 1, wherein the lock barrel is rotatable about the insertion axis.

4. The lock of claim 1, wherein the lock barrel includes a lock cylinder and a lock driver that is coupled to and co-rotatable with the lock cylinder.

5. The lock of claim 1, further comprising a set of locking balls disposed within the housing and interfering with a locking latch when the lock barrel is in the locked state.

6. The lock of claim 5, wherein the locking balls are permitted to retract radially inward relative to the insertion axis when the lock barrel is rotated to the unlocked state, thereby no longer interfering with the locking latch.

7. The lock of claim 1, wherein the key includes a set of grooves that receive the tumblers when the key is inserted into the lock barrel, wherein each groove has a length that determines the distance in which each tumbler is displaced relative to the lock barrel.

8. The lock of claim 1, wherein the notch of each tumbler is a primary notch and the key is a change key, the primary notch is capable of receiving the sidebar when the change key is inserted into the lock barrel, and wherein the lock further includes a secondary notch of each tumbler and a master key, the secondary notch is capable of receiving the sidebar when the master key is inserted into the lock barrel.

9. The lock of claim 1, wherein the notch of each tumbler is a primary notch and the key is a change key, and wherein the lock further includes a secondary notch of each tumbler and a master key, wherein the primary notch and the secondary notch overlap and merge to create a double-length notch that is capable of receiving the sidebar when both the change key is inserted and when the master key is inserted into the lock barrel.

10. The lock of claim 1, wherein the projection is asymmetrical such that the single-ramped surface is only on one side of the sidebar.

11. The lock of claim 1, wherein the sidebar extends transversely across the tumblers.

12. A lock comprising:

a housing;

a lock barrel having a first end configured to receive a key along an insertion axis and a second end, opposite the first end, the lock barrel includes a plurality of tumbler passageways open to the second end, wherein each of the plurality of tumbler passageways extends substantially parallel with the insertion axis;

a plurality of tumblers and corresponding tumbler springs received in the plurality of tumbler passageways, wherein the plurality tumblers are movable parallel to the insertion axis against a bias from the tumbler springs upon insertion of the key;

a sidebar extending through an aperture of the lock barrel and constrained thereby to movement along a linear path perpendicular to the insertion axis, the sidebar is engageable with a notch of the tumblers when the sidebar moves radially inward relative to the insertion axis, wherein the sidebar includes a cam surface slidable against the housing when the lock barrel rotates about the insertion axis and a projection having a single-ramped surface that is received within the notch of each tumbler when the lock barrel is in the unlocked state.

13. The lock of claim 12, wherein the key includes a set of grooves that receive the tumblers when the key is inserted into the lock barrel, wherein each groove has a length that determines the distance in which each tumbler is displaced relative to the lock barrel.

14. The lock of claim 12, wherein the notch of each tumbler is a primary notch and the key is a change key, the primary notch is capable of receiving the sidebar when the change key is inserted into the lock barrel, and wherein the lock further includes a secondary notch of each tumbler and a master key, the secondary notch is capable of receiving the sidebar when the master key is inserted into the lock barrel.

15. The lock of claim 12, wherein the notch of each tumbler is a primary notch and the key is a change key, and wherein the lock further includes a secondary notch of each tumbler and a master key, wherein the primary notch and the secondary notch overlap and merge to create a double-length notch that is capable of receiving the sidebar when both the change key is inserted and when the master key is inserted into the lock barrel.

16. The lock of claim 12, wherein the projection is asymmetrical such that the single-ramped surface is only on one side of the sidebar.

17. The lock of claim 12, wherein the notch includes a single-ramped surface that is slideable against the single-ramped surface of the sidebar to urge the sidebar radially outward relative to the insertion axis.

18. The lock of claim 12, wherein the sidebar extends transversely across the tumblers.

19. A linearly-actuated lock comprising:

a lock cylinder defining an insertion axis for receiving a key at a front axial end;

a plurality of tumblers and corresponding tumbler springs are received in passageways in the lock cylinder, wherein the plurality of tumblers are movable parallel to the insertion axis against a bias from the tumbler springs upon insertion of the key;

a sidebar movable radially inward relative to the insertion axis in response to movement of the plurality of tumblers in a direction parallel to the insertion axis;

a lock driver is removably coupled to the lock cylinder, the lock driver does not enclose the tumblers, the tumbler springs, or the sidebar, wherein the sidebar includes a cam surface and a projection having a single-ramped surface, wherein the single-ramped surface is capable of being received within a notch of each tumbler, and wherein the single-ramped surface faces a rear axial end of the lock, opposite the front axial end.

20. The lock of claim 19, wherein the notch includes a single-ramped surface that is slideable via the tumbler springs against the single-ramped surface of the sidebar to urge the sidebar radially outward relative to the insertion axis.

* * * * *